US006935998B2

(12) United States Patent
Silvestre

(10) Patent No.: US 6,935,998 B2
(45) Date of Patent: Aug. 30, 2005

(54) METHOD AND DEVICE FOR DETERMINING THE ACCURACY OF A FOLD POSITION

(75) Inventor: Alain Silvestre, Breuil le Vert (FR)

(73) Assignee: Goss International Americas, Inc., Dover, NH (US)

( * ) Notice: Subject to any disclaimer, the term of this patent is extended or adjusted under 35 U.S.C. 154(b) by 9 days.

(21) Appl. No.: 10/026,147

(22) Filed: Dec. 17, 2001

(65) Prior Publication Data

US 2002/0113977 A1 Aug. 22, 2002

(30) Foreign Application Priority Data

Dec. 20, 2000 (DE) ..... 100 63 528

(51) Int. Cl.[7] ..... B31F 1/00

(52) U.S. Cl. ..... 493/405; 493/417; 493/10; 493/11; 493/13

(58) Field of Search ..... 73/1.16, 1.24; 198/341.05; 271/3.13; 493/405, 417, 10, 11, 13, 14, 17, 19, 24, 36

(56) References Cited

U.S. PATENT DOCUMENTS 3,809,387 A * 5/1974 Heist et al. ..... 493/10
4,061,326 A * 12/1977 Proudman ..... 493/14
4,578,052 A * 3/1986 Engel et al. ..... 493/11
4,974,077 A * 11/1990 Kusaba ..... 382/141
5,007,096 A * 4/1991 Yoshida ..... 382/142
5,212,656 A * 5/1993 Clary et al. ..... 702/84
5,818,719 A * 10/1998 Brandon et al. ..... 700/125
5,930,139 A * 7/1999 Chapdelaine et al. ..... 700/118
6,086,522 A * 7/2000 Hechler ..... 493/23

FOREIGN PATENT DOCUMENTS

| | | |
|---|---|---|
| DE | 19743020 | 4/1999 |
| JP | 60137770 | 11/1985 |
| JP | 07277592 | 10/1995 |
| JP | 07277593 | 10/1995 |

* cited by examiner

*Primary Examiner*—Rinaldi I. Rada
*Assistant Examiner*—Brian Nash
(74) *Attorney, Agent, or Firm*—Davidson, Davidson & Kappel, LLC

(57) ABSTRACT

The present invention relates to a method and a device for analyzing the accuracy of a fold (3) which is produced via a folding apparatus for printed products. In the process, with the printed products (1) being shingled, sensors (4) detect the position of the fold with respect to markings (5) which are printed onto the printed product, the folding accuracy and other quantities connected therewith being determined therefrom with the aid of computers.

21 Claims, 2 Drawing Sheets

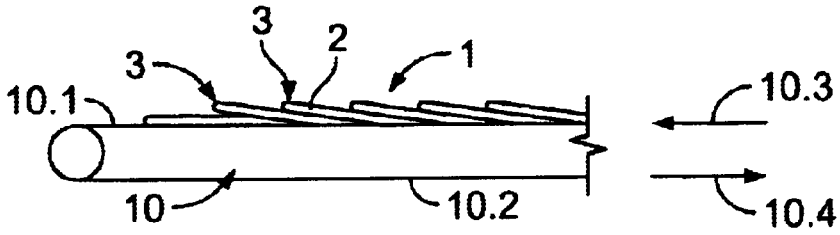
FIG. 1.1
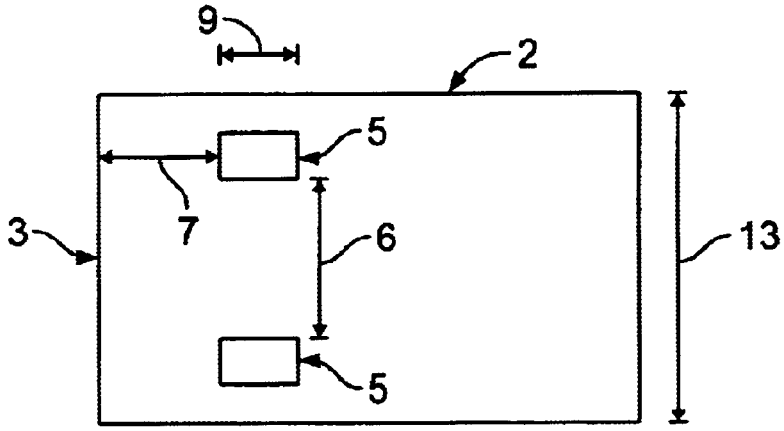
FIG. 1.2
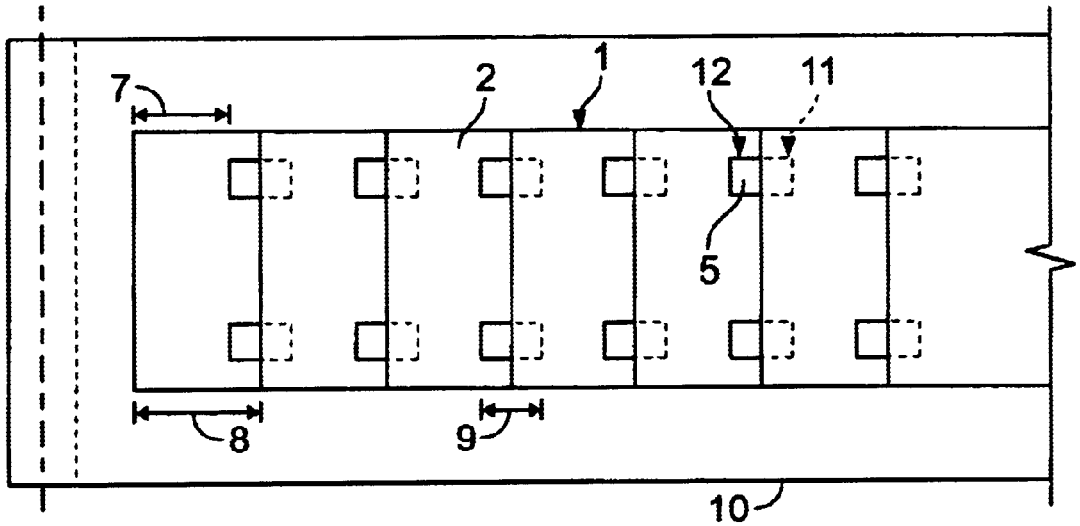
FIG. 1.3

METHOD AND DEVICE FOR DETERMINING THE ACCURACY OF A FOLD POSITION

BACKGROUND INFORMATION

The present invention relates to a method and a device for determining the accuracy of a fold position which is produced, for example, via a folding apparatus for printed products.

German Patent Application No. 197 43 020 relates to a separating device for printed products having a plurality of conveying elements for conveying the printed products. A series of printed products at least partially overlapping each other in a shingle-like manner and which are received from a pre-processing machine pass through the separating device and are converted to a series of spaced-apart printed products for feeding into a post-processing machine. The separating device possesses a detector element for detecting the degree of overlapping of the individual printed products overlapping each other in a shingle-like manner and an additional conveying element for accelerated conveyance of individual printed products for correcting the degree of overlapping or the distance between individual printed products.

In the related art, the fold position of printed products is assessed by a person carrying out a visual assessment. This is time-consuming and tiresome work which can take up to several hours a day. During this time, ususally only about 100 test copies can be examined. Moreover, human visual assessment of the folding accuracy involves the risk of assessment errors and of manipulations, possibily involuntary, of the results.

SUMMARY OF THE INVENTION

In view of the indicated related art, an object of the present invention is to automate the analysis of folding accuracy and, in this manner, to make it faster and more reliable.

The present invention provides a device for analyzing the positional accuracy of a fold (3) of a printed product (2) which is folded in a folding apparatus and conveyed in a shingle stream (1), characterized by sensors (4) which detect the position of the fold (3) relative to markings (5) which are applied to the printed product (2). The present invention also provide a method for analyzing the positional accuracy of a fold which is produced via a folding apparatus for printed products under a given configuration and at a given speed, comprising the following method steps: imprinting markings (5) onto the printed product (2) to be folded; folding the printed products (2) in a folding apparatus; conveying the folded printed products (2) further as a shingle stream (1) on a conveying element (10) at a substantially constant speed; measuring the time lag between two markings (5) of the printed products (2) with the aid of sensors (4) used for detecting contrasts which are located above the shingle stream (1).

The use of sensors and the evaluation via a computer permit a fast analysis of the folding accuracy so that, for example, the number of copies of the printed product which can be examined in the same period of time is increased by a factor of 10 or 20. Due to the fast analysis, it is possible to carry out a great number of tests, for example, with different types of paper or numbers of pages to gather knowledge about the folding accuracy in the whole possible range of producible products on the folding apparatuses. Via further tests, it is possible to extend the knowledge about the dynamics of the folding apparatus, for example, about the folding precision as a function of the speed. Since the device according to the present invention permits examination of a large number of test copies, the statistic meaningfulness of the calculated folding accuracy is increased. Moreover, this great number of examined copies makes it possible to gain knowledge about errors which occur with very small frequencies. Furthermore, the present invention can be used to provide service technicians or operators of the folding apparatus with an aid for error diagnosis. Using sensors, it is possible, moreover, to increase the measuring accuracy and to avoid the risk of human assessment errors or manipulations. The integration of a marking field in the print allows the printing accuracy to be fed back to the folding apparatus, thereby allowing measures for increasing the folding accuracy to be initiated in response to the occurrence of errors (such as oblique folds, overhanging paper), for example, an error correction using the folding mechanism or a speed control of the conveying element conveying the stream of shingles.

In a further embodiment of the basic idea of the present invention, the markings can include at least two, preferably rectangular dark areas which are preferably arranged on both sides of a copy of a printed product as viewed in the direction of conveyance. In this context, it is an advantage that the, for example, black areas constitute a well-detectable contrast over white background and that each rectangular black area features a sharp edge to the light, for example, white surroundings. In lieu of the dark areas, light markings can be used as well if the background, in particular the edge of the printed product, is dark up to the fold. Moreover, it is conceivable for register marks or print control bars, which are already applied to the printing-material web from which the printed products are produced, to be used as markings. In any case, the intention is to ensure a well detectable contrast between the marking and the background. The arrangement of the two areas on both sides of a copy at a distance from each other which nearly corresponds to the size of the printed product involves the advantage that the as large as possible a distance permits detection of even a slight obliqueness of the fold.

In the present invention, the markings are imprinted at a fixed distance from the nominal line of the fold to permit detection of a deviation of the fold from its nominal line. This distance is selected such that it is large enough for the detection of the light region defined by it and that it is smaller than the non-overlapped free space of the respective printed product so that the markings are not completely covered in the stream of shingles. Besides the physical properties of the sensors, the distance which is large enough for the detection also depends on the conveying speed of the printed products. To resolve the contrast changes between the respective marking and the fold, a larger distance of the markings from the fold is required in the case of a high conveying speed than in the case of a lower conveying speed.

The length of the markings is selected large enough so that a part of the respective marking of a printed product is covered by the printing product which follows in the stream of shingles.

In the present invention, the time lag between two markings on the shingled, folded printed products moving on a conveying element is measured using sensors for detecting contrasts, for example, CCD sensors. This time depends on the distance of the fold from the print marking. Via the nominal distance of the marking from the fold, a nominal time lag to be measured is defined for the at least two sensors. Deviations of the measured time lag from the nominal time lag suggest a folding error.

The absolute position of the fold relative to the markings can be derived from the measured time lag and the mean speed of the conveying element, it being possible to determine the mean speed from the mean time lag and the known nominal distance of the markings from the fold. This absolute position of the fold relative to the markings permits a statement on the accuracy of the fold, in particular as to whether it is situated in a central and straight line.

In a specific embodiment of the present invention, the respective position of the sensors relative to the printed products is adjustable in all three spatial directions. An adaptation to the width of different printed products is effected via a width-adjustment capability of the sensors.

The height-adjustment capability of the sensors permits an accurate focusing of the contrasts to be detected. The height can be adapted, in particular to the thickness of the printed products. Lower-contrast transitions between the markings and the background can be resolved better via an exact focusing. The adjustment settings for the sensors can be stored in advance for known or common kinds of printed products. They can then be retrieved in the case of a change between the different printed products, and an automatic adjustment of the sensors can take place.

In an advantageous embodiment of the device according to the present invention, the storage and analysis of the quantities measured by the sensors are carried out on a computer via already-existing software adapted to the existing problem or via newly-developed software for this task. Moreover, the software preferably evaluates the measured quantities statistically to ascertain also the variations of the folding position about its nominal position and the variation of the folding errors such as "oblique fold", "non-central fold" and "completely incorrect fold" in addition to the absolute position of the fold relative to the markings.

When folding errors occur, these can be directly fed back to the folding apparatus or to the appertaining control stand. In the case of a direct feedback to the folding apparatus, it is possible to initiate automatic measures for increasing the folding accuracy, for example, an automatic correction of the phase relation of the folding blade to the folding jaw or, in the extreme case, a shut down of the rotary press. In the event of a status signal to the control stand, it is advantageous to signal a warning, for example, on a video screen so that a technician can take measures, if required.

One way to forward an error message or the folding accuracy to machines for further processing machines, for example stackers, is to integrate marking fields in the print which contain information on the folding accuracy. To this end, the content of the marking fields must be readable at the further processing machines, using an appropriate read-out device.

To detect the contrasts between the marking and the background, it is preferred to use optical sensors. These optical sensors can measure, for example, the luminous intensity which is reflected from the printed product. In a specific embodiment of the present invention, the reflected light is light from the surroundings of the printed products, for example, light from neon tubes in a factory building. In another embodiment of the present invention, each sensor includes a transmitter unit and a receiver unit. The transmitter unit emits electromagnetic waves whose component which is reflected by the respective printed product is measured by the receiver unit of the sensor.

In a specific embodiment of the present invention, a plurality of conveying elements are arranged side by side, at least two sensors per shingle stream being situated above the shingled printed products which are conveyed thereon. They measure the time lag between the contrast transitions of the imprinted markings against the background surrounding them to determine the folding accuracy in the respective stream of shingles. The evaluation of the values measured by the sensors can be carried out for all shingle streams with the aid of the same software.

According to the method proposed according to the present invention for analyzing the accuracy of a fold produced by a folding apparatus, the application, in particular the imprinting of markings, the folding of the printed products and their conveyance in a shingled manner are carried out before the time lag between two markings is measured by sensors for detecting contrasts which are situated above the stream of shingles. Subsequently, the measured quantities are evaluated via software so that a statement can be made on the folding accuracy and occurring errors.

According to the present invention, a folding apparatus can contain a device for analyzing the accuracy of a fold produced by the folding machine.

BRIEF DESCRIPTION OF THE DRAWINGS

In the following, the present invention will be explained in greater detail with reference to the drawing.

FIG. 1.1 is a lateral view of folded, shingled printed products on a conveying element;

FIG. 1.2 shows the top view of a single copy of a printed product having two markings;

FIG. 1.3 is the top view of a conveying element with folded, shingled, marked printed products;

DETAILED DESCRIPTION OF THE PREFFERED EMBODIMENTS

Figure 2:
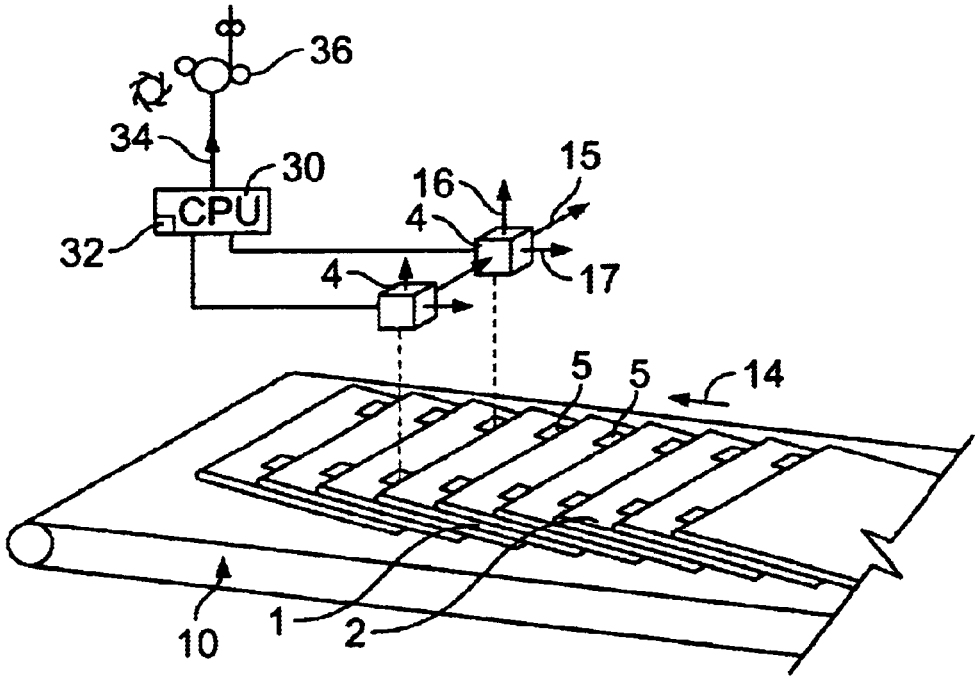
FIG. 2 shows two sensors above a stream of shingles.

FIG. 1.1 shows shingled printed products in a shingle stream 1 which feature a fold 3 and are situated on a conveying element 10 composed, for example, of a conveyer band or belts, which may for example in a continuous loop. Printed products 2 are situated on upper side 10.1 of the conveyer band and preferably have a moving direction 10.3 with folding spine 3 being in a front or leading position. Conveyer band lower side 10.2 moves in a direction opposite thereto (in direction 10.4). In the shingle stream shown in FIG. 1.1, printed products 2 are arranged in an overlappingly shingled manner, the leading edge of a following printed product 2 coming to rest on the upper side of the preceding printed product 2.

FIG. 1.2 depicts a single printed product 2 which is provided with a fold 3 and features two markings 5 which are, for example, rectangular. Distance 6 of the two markings 5 is slightly smaller than size 13 of the printed product. Markings 5 have a distance 7 from fold 3 and a length 9.

FIG. 1.3 shows that distance 7 and length 9 of the markings 5 are selected such that part 11 of the respective marking 5 is covered by a printed product 2 that follows in shingle stream 1, and that a part 12 of the marking is not covered in non-overlapped free space 8 of the printed product.

FIG. 2 illustratively shows two sensors 4 which are fastened above markings 5 of printed product shingle stream 1. In this example, the shingle stream 1 of overshingled printed products 2 moves on conveying element 10 in the direction of arrow 14 passing under sensors 4 which detect therefrom alternating light and dark areas. The time lag between two successive dark areas (in direction 14) is measured from the sensor signals using a computer or evaluation device 30, which includes a memory 32, receiving inputs from sensors 4. The evaluation device 30 can release a control signal 34 to a folder 36, shown representatively, that produces stream 1. The control signal 34 can alter the speed of folder 36 to change the position of future printed products 2, and thus a closed-loop control system is created. Since the edge 3 overlaps a marking 5, the measured time lag between two successive detected (dark) markings 5 corresponds to the distance between folding edge 3 of a printed product 2 and the leading edge of the marking 5 on the next printed product 2 and, consequently, to the position of fold 3. Sensors 4 are preferably adjustable in the x-, y- and z-directions (reference numerals 15, 16, 17) so that they can be moved to a position exactly perpendicular above the markings for all kinds of printed products, and that these can be precisely focused.

Figure 3:
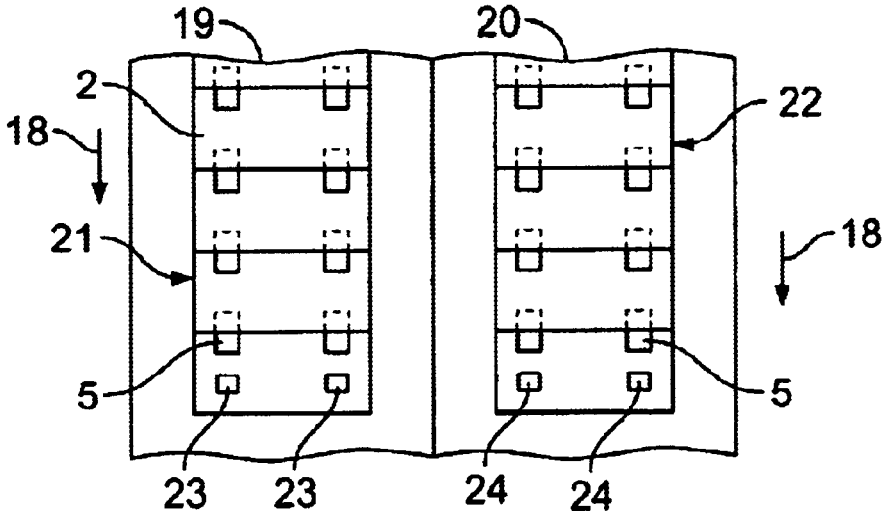
FIG. 3 is the top view of two shingle streams arranged side by side, including sensors.

FIG. 3 depicts two conveying elements 19 and 20, side by side, two sensors 23 and 24 being installed above each conveying element, respectively, so that they are situated above markings 5 printed on the printed products. Shingle streams 21 and 22 move, for example, in the same moving direction 18 on their conveying elements 19 and 20, passing under sensors 23 and 24. Sensors 23 and 24 can individually be adapted to the respective shingle stream in terms of their adjustment. They are alternatingly directed to the light and dark areas and measure the time lag between two dark areas. The evaluation of the values measured by sensors 23 and 24 is carried out with the aid of the same software.

In the case of shingle streams 21 and 22 depicted in FIGS. 1.1, 1.2, 1.3, 2 and 3, printed products 2 are arranged in an overlapping shingled manner and sensors 4 are located above the conveying element of conveyer band 10. However, it is equally possible for conveying element 10 to be constituted by two or a plurality of conveying bands or conveying belts running parallel side by side and for sensors 4 to be positioned below the shingle stream for detecting markings 5 which are situated on the lower side of printed products 2. In this case, the shingle stream is configured as a so-called "underlappingly shingled" stream of shingles in which the folded edge or fold 3 of the printed product 2 that follows in the direction of conveyance comes to rest below the printed product 2 preceding in the direction of conveyance.

| List of Reference Numerals | |
|---|---|
| 1 | Shingle stream |
| 2 | Folded printed product |
| 3 | Fold |
| 4 | Sensors |
| 5 | Markings |
| 6 | Distance of the two markings |
| 7 | Distance of the marking from the fold |
| 8 | Non-overlapped free space |
| 9 | Length of the marking |
| 10 | Conveying element |
| 10.1 | Upper side of conveyer band |
| 10.2 | Lower side of conveyer band |
| 10.3 | Moving direction of the printed products |
| 10.4 | Moving direction of the conveyer band lower side |
| 11 | Covered part of the marking |

-continued

| List of Reference Numerals | |
|---|---|
| 12 | Non-covered part of the marking |
| 13 | Size of the printed product |
| 14 | Moving direction of the shingle stream |
| 15 | x-direction |
| 16 | y-direction |
| 17 | z-direction |
| 18 | Moving direction of both shingle streams |
| 19 | First conveying element |
| 20 | Second conveying element |
| 21 | First shingle stream |
| 22 | Second shingle stream |
| 23 | First sensors |
| 24 | Second sensors |
| 30 | Evaluation device |
| 32 | Memory |
| 34 | Control signal |
| 36 | Folder |

What is claimed is:

1. A device for analyzing the positional accuracy of a fold of printed products conveyed in a shingle stream comprising:

sensors detecting a position of the fold relative to markings applied to the printed product; and an evaluation device connected to the sensors for determining a time lag between two signals of at least one of the sensors, the signals corresponding to a contrast change at the markings;

the signals corresponding to the contrast change alternately indicating a front edge of a first marking of the markings or a folding edge of another printed product covering the first marking; wherein the evaluation device determines the position of the fold by comparing the time lag measured for each marking and ascertains the position of the fold as a function of the measured time lag multiplied by a speed of the printed product.

2. The device as recited in claim 1 wherein the markings include at least two light or dark areas.

3. The device as recited in claim 2 wherein the markings are rectangular.

4. The device as recited in claim 2 wherein one of the light or dark areas is on one side of the printed product and the other of light or dark areas is on the other side of the printed product.

5. The device as recited in claim 4 wherein the two light or dark areas are at the edges of the sides of the printed product.

6. The device as recited in claim 1 wherein the sensors include two sensors assigned to the first marking and a second marking of the markings.

7. The device as recited in claim 1 wherein the markings are imprinted at a fixed distance from a nominal fold line, the fixed distance being larger than a distance required for detection and smaller than a non-overlapped free space of the printed product, so that a part of the marking of the printed product is covered and another part is not covered by another printed product.

8. The device as recited in claim 1 wherein a length of the marking is selected so that a part of the marking is covered by a following printing product.

9. The device as recited in claim 1 wherein the speed is determined as a function of a mean speed of the printed products conveyed on conveying elements, the mean speed being calculated by averaging time lag measurements for a plurality of successive printed products.

10. The device as recited in claim 9 wherein the evaluation device includes software for determining at least one of the mean speed, the time lag, and an analysis for determining the folding accuracy.

11. The device as recited in claim 10 wherein the analysis for determining the folding accuracy includes detection of at least one of non-central fold, oblique fold and completely incorrect fold errors.

12. The device as recited in claim 11 wherein the analysis is a function of the marking.

13. The device as recited in claim 12 wherein data for the folding accuracy is read out and utilized for correcting the position of the fold.

14. The device as recited in claim 10 wherein the software includes a closed-loop control circuit for controlling and correcting the position of the fold.

15. A folding apparatus comprising a device for analyzing an accuracy of a fold produced via the folding apparatus under a given configuration at a given speed according to claim 1.

16. A device for analyzing the positional accuracy of a fold of printed products conveyed in a shingle stream comprising:

a sensor producing signals, the signals being a function of a plurality of contrast changes between dark markings on the printed products and light areas of the printed products; and an evaluation device connected to the sensor for determining a time lag between two of the plurality of contrast changes;

wherein the plurality of contrast changes includes a first contrast change indicating a lead edge of a first of the dark markings on a first printed product, and a second contrast change indicating a folding edge of a second printed product covering the first dark marking; wherein the evaluation device determines the position of the fold by comparing the time lag measured for each marking and ascertains the position of the fold as a function of the measured time lag multiplied by a speed of the printed product.

17. A printed product conveyor comprising:

a conveying element;

a first folded printed product being conveyed by the conveying element in a conveying direction and having a first marking extending in the conveying direction and having a first marking length in the conveying direction;

a second folded printed product being conveyed by the conveying element in a shingled manner so a fold of the second folded printed product covers the first marking to define an uncovered portion of the first marking, the uncovered portion of the first marking being shorter in the conveying direction than the first marking length, the uncovered portion having a front edge and a rear edge;

the second printed product having a second marking with a second front edge extending in the conveying direction;

a sensor sensing the front edge of the uncovered portion, the rear edge of the uncovered portion and the second front edge of the second marking; and an evaluation device receiving an input from the sensor.

18. The printed product conveyor as recited in claim 17 wherein the evaluation device determines a position of the fold of the second printed product with respect to the first printed product as a function of the sensor input.

19. The printed product conveyor as recited in claim 17 further comprising a second sensor and a further marking on the first folded printed product, the second sensor sensing the further marking.

20. The printed product conveyor as recited in claim 17 wherein the sensor is adjustable in all directions.

21. The printed product conveyor as recited in claim 17 wherein the conveying element is a conveyor band.

* * * * *